US009739460B2

(12) United States Patent
Haubach

(10) Patent No.: US 9,739,460 B2
(45) Date of Patent: Aug. 22, 2017

(54) INTERCHANGEABLE LIGHTING FIXTURES FOR TRACK AND WALL LIGHTING SYSTEM

(71) Applicant: Evolution Lighting, LLC, Miami Lakes, FL (US)

(72) Inventor: Timothy J. Haubach, Allison Park, PA (US)

(73) Assignee: Evolution Lighting, LLC, Miami Lakes, FL (US)

( * ) Notice: Subject to any disclaimer, the term of this patent is extended or adjusted under 35 U.S.C. 154(b) by 367 days.

(21) Appl. No.: 14/460,746

(22) Filed: Aug. 15, 2014

(65) Prior Publication Data

US 2015/0049513 A1 Feb. 19, 2015

Related U.S. Application Data

(60) Provisional application No. 61/866,317, filed on Aug. 15, 2013.

(51) Int. Cl.

| | |
|---|---|
| ***F21S 8/04*** | (2006.01) |
| ***F21V 19/04*** | (2006.01) |
| ***F21S 8/00*** | (2006.01) |
| ***F21V 19/00*** | (2006.01) |
| ***F21V 21/30*** | (2006.01) |
| *F21V 21/34* | (2006.01) |

(52) U.S. Cl.
CPC ..... *F21V 19/04* (2013.01); *F21S 8/033* (2013.01); *F21S 8/038* (2013.01); *F21S 8/04* (2013.01); *F21V 19/007* (2013.01); *F21V 21/30* (2013.01); *F21V 21/34* (2013.01)

(58) Field of Classification Search
CPC ..... F21V 19/007; F21V 19/04; F21V 21/30; F21S 8/033; F21S 8/038; F21S 8/04
See application file for complete search history.

(56) References Cited

U.S. PATENT DOCUMENTS 5,788,518 A * 8/1998 Wachter ..... F21V 21/30 362/287

* cited by examiner

*Primary Examiner* — Thomas M Sember
(74) *Attorney, Agent, or Firm* — Greenberg Traurig, LLP

(57) ABSTRACT

An exchangeable head lighting system may include a canopy and one or more exchangeable lighting heads. The canopy may include a support post configured to receive a connecting post. The support post may provide electrical power to the connecting post. The exchangeable lighting heads may each include a connecting post. The connecting post may be configured to securely interface with the support post such that a rotatable and releasable connection is formed when the connecting post is inserted within the support post. The connecting post may have electrical connections situated to receive electrical power from the support post. The one or more exchangeable lighting heads may include a housing containing a light source.

14 Claims, 4 Drawing Sheets

INTERCHANGEABLE LIGHTING FIXTURES FOR TRACK AND WALL LIGHTING SYSTEM

FIELD OF THE INVENTION

This invention relates generally to the field of lighting fixtures, and more specifically to an interchangeable head lighting system.

BACKGROUND OF THE INVENTION

Track and wall lighting have become ubiquitous for commercial and many home lighting displays. Track lighting affords flexibility in placing and directing lighting without the necessity of providing separate wiring for each desired lamp. Track lighting is typically mounted horizontally to a ceiling or other overhead structure and has the advantage of providing light that is emitted from an elevated location. Wall and ceiling lighting are typically mounted to a flat wall or ceiling having a power supply situated behind the wall or ceiling, or can be in the form of a portable fixture that is electrified via a power cord with a plug. The wall or ceiling fixture generally consists of a decorative canopy which conceals the power (inline source) supply and assists with mounting or affixing the fixture to the wall in a desired position. Track lighting generally consists of a decorative canopy or similar cover that conceals the inline (source) wire and the fixture wiring. Any number of lighting fixtures may be attached to the fixed canopy, bar or rail and extend from it. Lighting fixtures may provide flood lighting, spot lighting, diffused lighting or other special effects, depending upon the kind of lighting fixture attached to a track. The light fixture may include a single head and canopy or multiple heads which are attached to a horizontal or vertical back plate or bar which is then affixed to the canopy. Occasionally, a user of track, wall or ceiling lighting may want to modify the lighting effect to accommodate changes in the room or simply to provide a variety of lighting effects over time.

Because most track and ceiling lighting, and some wall lighting, is situated in high, out-of-easy-reach ceilings or other overhead structures, installations tend to be permanent, and the ability of a non-electrician user to change lighting fixtures or to modify lighting effects is correspondingly limited. What is needed is a set of lighting fixtures that use a common base, and that may be easily interchangeable to allow a non-technician to create different lighting effects by changing only the fixture. This invention permits for interchangeable flexibility of the lighting device without the need to re-wire the fixture to its permanent or semi-permanent surface mounting or installation.

SUMMARY OF THE INVENTION

The following presents a simplified summary of the disclosure in order to provide a basic understanding of some aspects of various embodiments disclosed herein. This summary is not an extensive overview of the disclosure. It is intended to neither identify key or critical elements of the disclosed embodiments nor delineate the scope of those embodiments. Its sole purpose is to present some concepts of the invention in a simplified form as a prelude to the more detailed description that is presented later.

The invention is a modular base and lamp housing in which a variety of lamp fixtures can be easily exchanged and used in the same base. The attachment between the base and the lamp housing is a bayonet-style connector in which the base has a support post with a female connector plug and each of the lamp housings has a corresponding connecting post comprising a male connector plug. The method of securing the attachment can be a set screw or, alternatively, may be a twist and turn or a spring-loaded ball bearing and corresponding groove or detent. Wiring is integral to the support posts and no external wiring is present. In a preferred embodiment, a ball and socket joint between the lamp housing support post and the lamp housing itself permits the lamp to be tilted and rotated in any desired direction. In addition, the lamp housing may be rotated 360° about the axis of the support post without being restricted as there is no wired connection in the bayonet connector. Other embodiments may use pivot joints and swivel joints to provide directional orientation. The base may be used in connection with a track that supplies electricity to the fixture, or may be a single mount attached to a wall or ceiling. Although the invention is suitable to be used with a track, it may be used in connection with other surfaces such as a wall or a ceiling.

DETAILED DESCRIPTION OF THE PREFERRED EMBODIMENTS

The following detailed description and the appended drawings describe and illustrate exemplary embodiments of the invention solely for the purpose of enabling one of ordinary skill in the relevant art to make and use the invention. As such, the detailed description and illustration of these embodiments are purely exemplary in nature and are in no way intended to limit the scope of the invention, or its protection, in any manner. It should also be understood that the drawings are not to scale and in certain instances details have been omitted, which are not necessary for an understanding of the present invention, such as conventional details of fabrication and assembly.

Figure 1A:
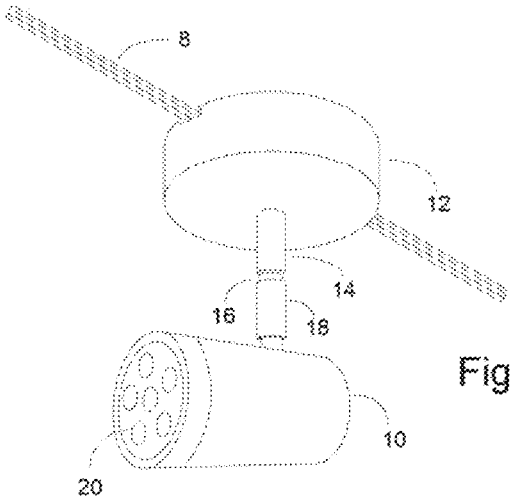
FIG. 1*a* is a perspective view of the exchangeable head lighting unit as installed in a single canopy as part of a track lighting system.

FIG. 1*a* is a view of the exchangeable head lighting system of the invention mounted on a single canopy and attached to a track lighting system. Canopy 12 is configured to receive electrical power from, and be supported by, an electrified track 8. Canopy 12 includes support post 14, which is a female component of a bayonet-style connector. Exchangeable lighting head 10 is attached to connecting post 18. The exchangeable lighting head 10 has at least one light source 20. The light source 20 may be, for example, a spotlamp, floodlamp, fluorescent bulb, LED, or other illuminating device known to those of skill in the art. Connecting post 18 has a portion having a reduced diameter 16 which its into support post 14. As depicted in FIG. 1*a*, connecting post 18 and support post 14 are slightly apart from a secure attachment. When securely attached, reduced diameter portion 16 will be within support post 14, will not be visible.

Figure 1B:
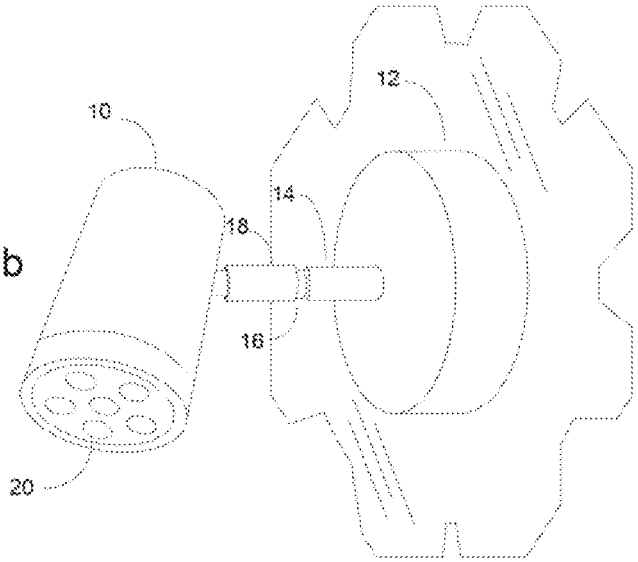
FIG. 1*b* is a perspective view of the exchangeable head lighting unit of FIG. 1 installed on a vertically oriented wall.

FIG. 1*b* shows the fixture of FIG. 1 mounted on a vertically oriented surface in which in-wall wiring extends through the wall and is connected to the unit behind the canopy 12.

Figure 1C:
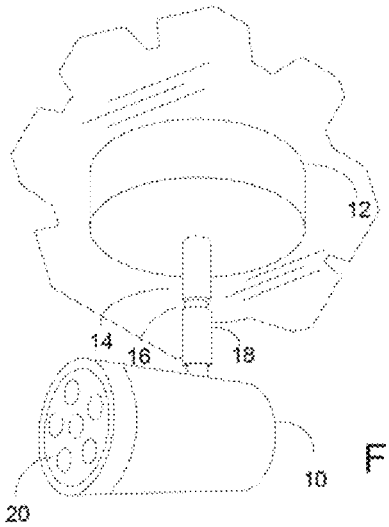
FIG. 1*c* is a perspective view of the exchangeable head lighting unit as installed in a single canopy/backplate that is affixed to a ceiling.

FIG. 1*c* is a view of the exchangeable head lighting system of the invention mounted on a single canopy 12 on a ceiling.

Figure 2:
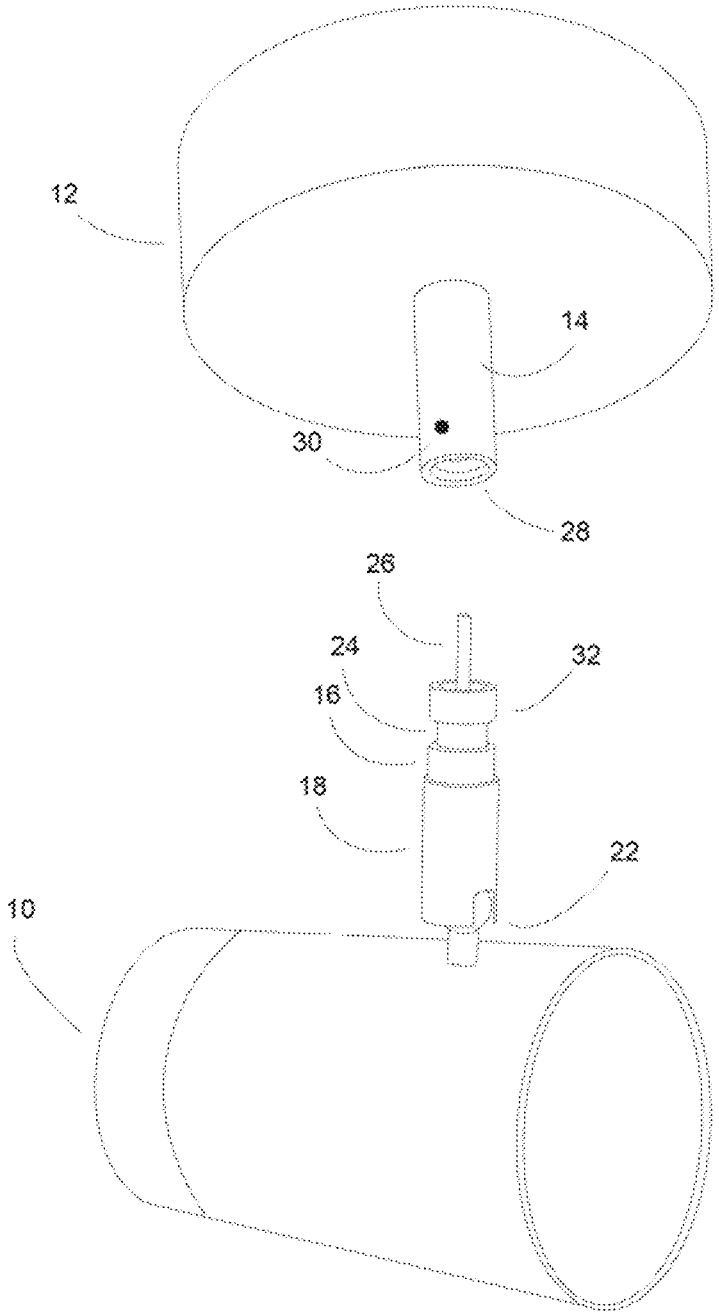
FIG. 2 is a perspective view of the separate canopy and exchangeable head of the exchangeable head lighting unit.

FIG. 2 depicts the components shown in FIG. 1 in a detached position. Support post 14 has a hole 30 to receive a set screw or other tightening mechanism that will fit within waist portion 24 of connecting post 18 to secure exchangeable lighting head 10 within support post 14. Cavity 28 receives electrical contact 26 and the reduced diameter portion 16 and 32 of connecting post 18. Electrical connections within support post 14 and connecting post 18 may be of any conventional type of electrical bayonet-type connector as is well known in the art. Ball joint 22 at the lower end of connecting post 18 permits great flexibility and directional adjustment for exchangeable lighting head 10.

Figure 3:
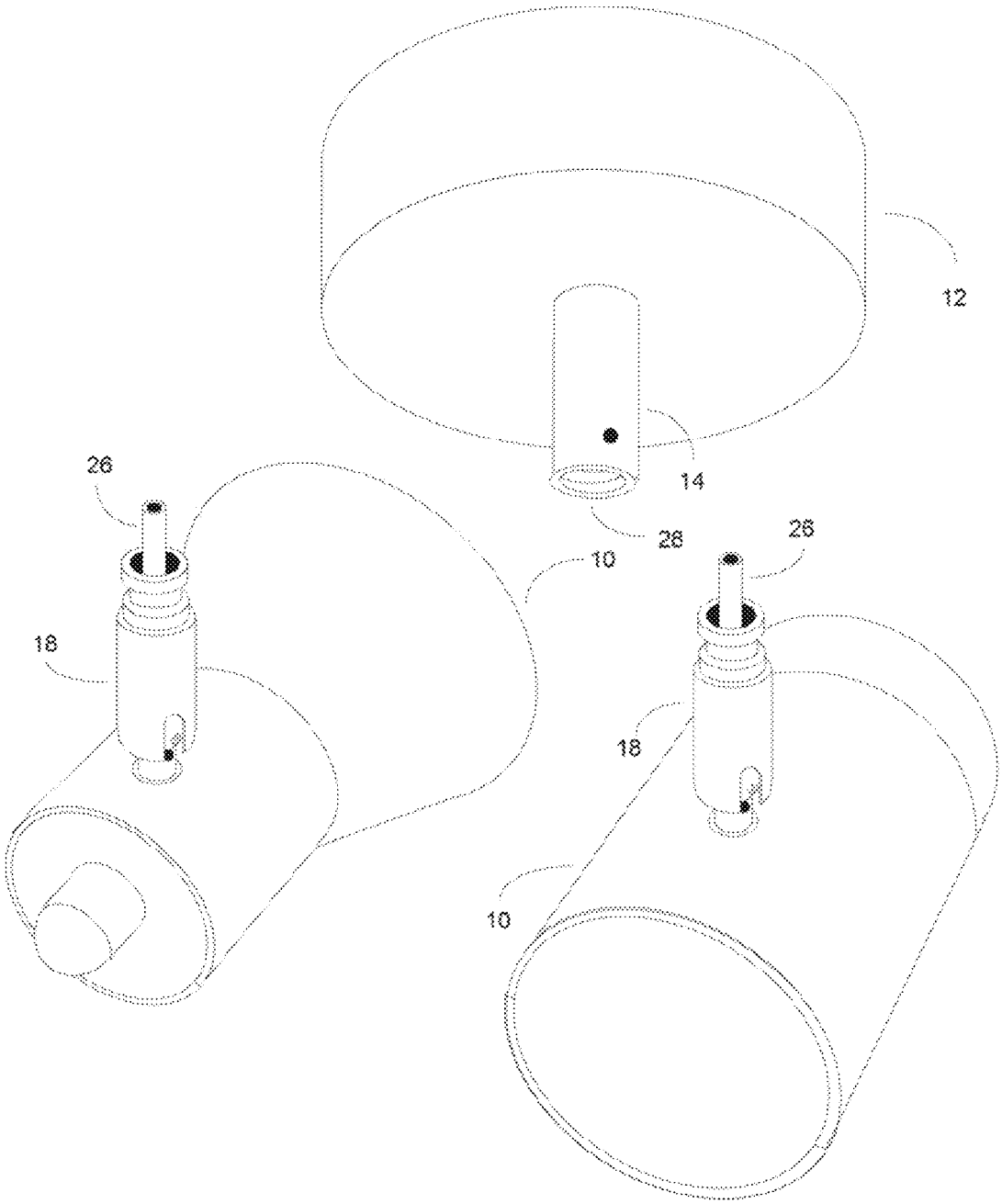
FIG. 3 is a perspective view of the canopy and two interchangeable heads of the exchangeable head lighting unit.

FIG. 3 shows two exchangeable lighting heads 10 having different shapes and that may have different functions, e.g., flood light or spot light. Both exchangeable lighting heads have an identical connecting post 18 with electrical contact 26 that will be received within cavity 28 of support post 14 on base 12.

Figure 4:
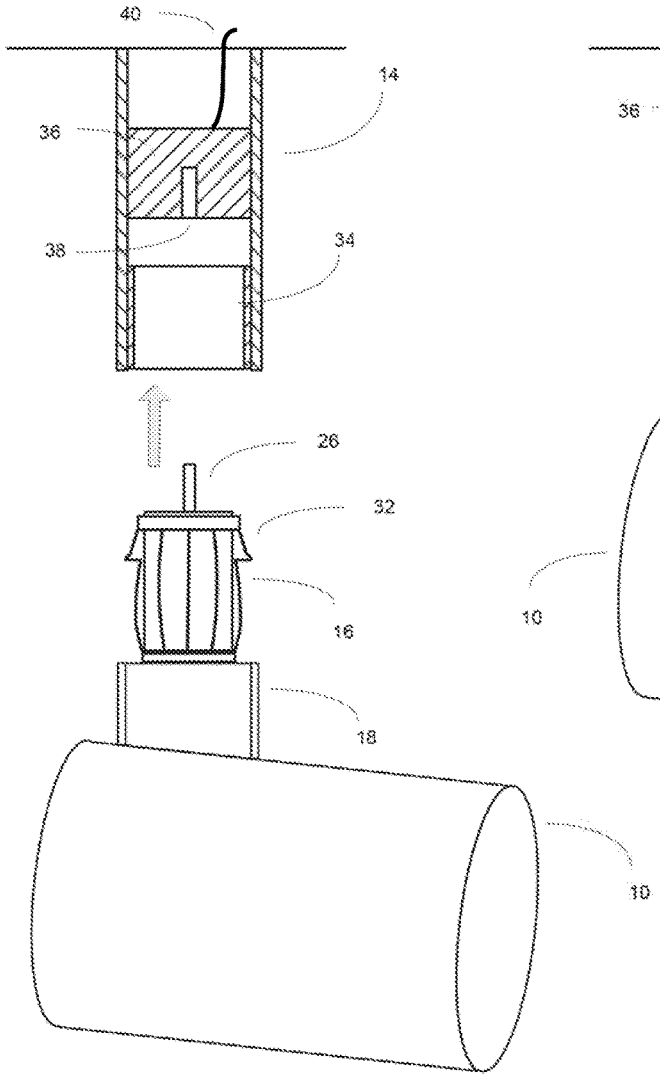
FIG. 4 is a perspective view of another embodiment of the exchangeable head lighting unit in a detached position.
Figure 5:
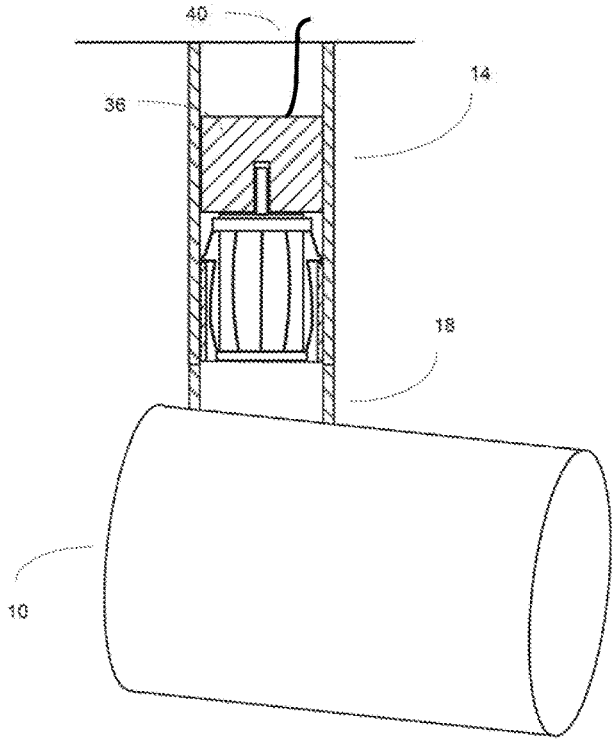
FIG. 5 is a perspective view of the exchangeable head lighting unit of FIG. 4 in an attached position.

FIGS. 4 and 5 show another embodiment of the exchangeable head lighting unit in detached and attached positions, respectively. Support post 14 may also include an inner sleeve 34, an inner electrical contact 36, a recess 38, and a wire 40. The inner sleeve 34 may be configured to receive the reduced diameter portions 16, 32 of the connecting post 18. Reduced diameter portion 32 may carry a friction fit spring clip of greater diameter than the inner sleeve 34. As those in the art will appreciate, this may assist securing the connecting post 18 to the support post 14. The inner sleeve 34 may be electrically grounded and provide a return path for electric current flowing to the exchangeable lighting head 10. The inner electrical contact 36 may be configured to receive electrical contact 26, for example, a female-style bayonet electrical contact with a recess 38. The wire 40 may be connected to the inner electrical contact 36 to provide electrical power to the system. The wire 40 may carry 12 volts. In some embodiments, the exchangeable head lighting unit may include a step-down transformer to convert high voltage alternating current to low voltage direct current. The step-down transformer may be arranged, for example, in the support post 14 or the canopy 12.

It will be apparent to persons of ordinary skill in the art that various embodiments will be possible with this invention, and that the invention is not limited to the embodiments depicted and described herein, but is limited only by the claims.

What is claimed:

1. An exchangeable head lighting system, comprising:

a canopy and one or more exchangeable lighting heads;

said canopy comprising a support post configured to receive a connecting post, said support post providing electrical power to said connecting post, wherein i. said support post and said connecting post further comprising a bayonet-style electrical connection and ii. said bayonet-style electrical connection including a male bayonet electrical connector connected to said connecting post and a female bayonet electrical connector connected to said supporting post;

said one or more exchangeable lighting heads each comprising said connecting post, each said connecting post being configured to securely interface with said support post such that a rotatable and releasable connection is formed when said connecting post is inserted within said support post, said connecting post having electrical connections situated to receive electrical power from said support post; and said one or more exchangeable lighting heads comprising a housing containing a light source.

2. The exchangeable head lighting system claimed in claim 1, further comprising an electrically conductive inner sleeve housed within said support post.

3. The exchangeable head lighting system claimed in claim 1, further comprising a spring clip carried by said connecting post.

4. The exchangeable head lighting system of claim 1, further comprising a low voltage power supply.

5. The exchangeable head lighting system of claim 4, wherein the low voltage power supply is a 12 volt power supply.

6. The exchangeable head lighting system of claim 1, wherein the canopy is mounted to a wall, ceiling or other surface.

7. The exchangeable head lighting system of claim 1, further comprising an electrified track, wherein said canopy is slidably connected to said electrified track.

8. An exchangeable head lighting system, comprising:

a canopy and one or more exchangeable lighting heads;

said canopy comprising a support post configured to receive a connecting post, said support post providing electrical power to said connecting post;

said one or more exchangeable lighting heads comprising a housing containing a light source, wherein said light source comprising at least one from a group consisting of a spotlamp, a floodlamp, and a plurality of lamps, whereby each said exchangeable lighting head provides a predetermined lighting effect when energized;

said one or more exchangeable lighting heads each comprising said connecting post, each said connecting post being configured to securely interface with said support post such that a rotatable and releasable connection is formed when said connecting post is inserted within said support post, said connecting post having electrical connections situated to receive electrical power from said support post, wherein said one or more exchangeable lighting heads further comprising a swivel joint whereby said housing and said connecting post are flexibly attached such that said housing is supported by said connecting post and may be oriented to direct light from said light source in a desired direction.

9. A track lighting system, comprising:

an electrified track, a canopy and one or more exchangeable lighting heads;

said canopy comprising a support post configured to receive a connecting post, said support post providing electrical power to said connecting post, wherein i. said support post and said connecting post further comprising a bayonet-style electrical connection, and ii. said bayonet-style electrical connection including a male bayonet electrical connector connected to said connecting post and a female bayonet electrical connector connected to said supporting post;

said one or more exchangeable lighting heads each comprising said connecting post, each said connecting post being configured to securely interface with said support post such that a rotatable and releasable connection is formed when said connecting post is inserted within said support post, said connecting post having electrical connections situated to receive electrical power from said support post; and said one or more exchangeable lighting heads comprising a housing containing a light source.

10. The track lighting system claimed in claim 9, further comprising an electrically conductive inner sleeve housed within said support post.

11. The track lighting system claimed in claim 9, further comprising a spring clip carried by said connecting post.

12. The track lighting system of claim 9, further comprising a low voltage power supply.

13. The track lighting system of claim 12, wherein the low voltage power sully is a 12 volt power supply.

14. A track lighting system, comprising:

an electrified track, a canopy and one or more exchangeable lighting heads;

said canopy comprising a support post configured to receive a connecting post, said support post providing electrical power to said connecting post;

said one or more exchangeable lighting heads comprising a housing containing a light source, wherein said light source comprising at least one from a group consisting of a spotlamp, a floodlamp, and a plurality of lamps, whereby each said exchangeable lighting head provides a predetermined lighting effect when energized;

said one or more exchangeable lighting heads each comprising said connecting post, each said connecting post being configured to securely interface with said support post such that a rotatable and releasable connection is formed when said connecting post is inserted within said support post, said connecting post having electrical connections situated to receive electrical power from said support post, said one or more exchangeable lighting heads further comprising a swivel joint whereby said housing and said connecting post are flexibly attached such that said housing is supported by said connecting post and may be oriented to direct light from said light source in a desired direction.

* * * * *